United States Patent [19]

Idec

[11] 4,323,157

[45] Apr. 6, 1982

[54] BOTTOM-FILLABLE LIPSTICK OR THE LIKE CONTAINER

[75] Inventor: Eric J. Idec, Madison, Conn.

[73] Assignee: Eyelet Specialty Co., Inc., Wallingford, Conn.

[21] Appl. No.: 197,809

[22] Filed: Oct. 17, 1980

[51] Int. Cl.[3] ..... B65D 85/72

[52] U.S. Cl. ..... 206/385; 132/79 C

[58] Field of Search ..... 206/385; 132/79 C, 88.7, 132/88.5; 401/78, 75, 71, 72, 68

[56] References Cited

U.S. PATENT DOCUMENTS

| | | | |
|---|---|---|---|
| 2,751,914 | 6/1956 | Katz | 132/79 C |
| 2,814,384 | 11/1957 | Dulberg | 132/79 C |
| 3,230,960 | 1/1966 | Moore et al. | 206/385 |
| 3,310,168 | 3/1967 | Landen . | |
| 3,991,775 | 11/1976 | Spatz | 132/79 C |
| 4,180,163 | 12/1979 | Grioni | 206/385 |
| 4,182,945 | 1/1980 | McArdle et al. | 206/385 |

FOREIGN PATENT DOCUMENTS

| | | | |
|---|---|---|---|
| 2036696 | 7/1980 | United Kingdom | 206/385 |

*Primary Examiner*—Joseph Man-Fu Moy

*Attorney, Agent, or Firm*—Hopgood, Calimafde, Kalil, Blaustein & Judlowe

[57] ABSTRACT

The invention contemplates a modified propel-repel cosmetic-container construction wherein bottom-filling of the container is made possible via filler-tube access ports in the base end of the container and in the pomade-support platform of the pomade-carrier. Carrier propulsion is via slot and internal-thread cams on the respective inner and outer rotatable tubular members of the container, and the arrangement is such that for the lowermost position of the carrier, the upper end of the carrier laps and, therefore, seals off the upper end of the cam slot.

14 Claims, 5 Drawing Figures

BOTTOM-FILLABLE LIPSTICK OR THE LIKE CONTAINER

BACKGROUND OF THE INVENTION

The invention relates to propel-repel cosmetic or the like containers wherein a pomade-loaded carrier is longitudinally positionable through relative rotation of inner and outer tubular members, relying upon a cam follower on the carrier to simultaneously track a slot cam of the outer member.

More particularly, the invention pertains to such containers wherein the pomade is extrudable through a dispensing opening in an upwardly projecting end of the inner tubular member, the only requisite propel-repel action being that which can expose only a small usable fraction of the pomade for use at a particular time—retraction, if any, being limited to that which will barely retract any exposed fraction of unused pomade.

Containers of the indicated type and currently in the marketplace require hand insertion of a solid mass of pomade into the dispensing opening, i.e., via the top or applicator end of the container. This technique is necessarily costly, requires skill and care to avoid waste through pomade damage, and in general does not lend itself to the high-production filling rates which are achievable for other types of cosmetic container and which are needed in a highly competitive industry, such as the cosmetics industry. Bottom-filling is desirable, but the indicated containers do not lend themselves to bottom-filling, namely, when the carrier is in its most retracted position.

BRIEF STATEMENT OF THE INVENTION

It is an object of the invention to provide an improved container of the character indicated, specifically and inherently capable of bottom-filling with extruded cosmetic or the like pomade.

A specific object is to meet the above object with structure whereby bottom-filling with an extruded deposit of pomade cannot result in pomade entry into any part of the propulsion mechanism, even for the most retracted position of the carrier.

A general object is to meet the foregoing objects with structure of no greater complexity or cost than current top-fillable containers.

The invention achieves these and other objects and features in a structure wherein the carrier and the propulsion mechanism are of substantially the same length, being approximately one half the overall length of the container. Importantly, for the most retracted position of the carrier, the upper end of the carrier laps the upper end of the cam slot of the inner tubular member, so that when pomade is extruded through a filler tube via the base end of the container, the extruded deposit fills only the pomade-supporting end of the carrier and the smooth cylindrical dispensing bore of the inner tubular member, free of any possible access to the propulsion mechanism.

DETAILED DESCRIPTION OF A PREFERRED EMBODIMENT

The invention will be illustratively described in connection with the accompanying drawings, in which.

Figure 1:
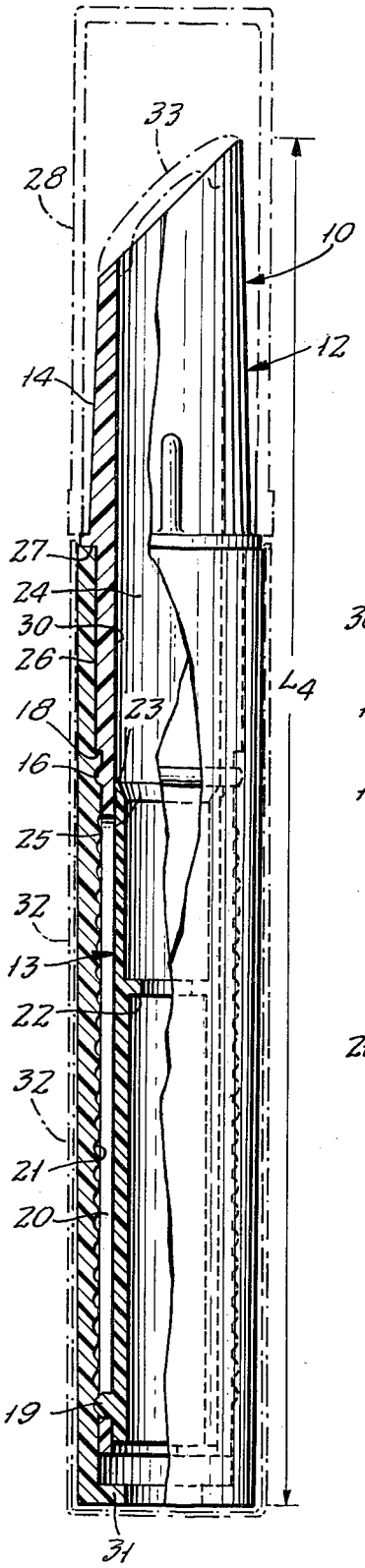
FIG. 1 is a view in elevation of a container of the invention, partly broken away and in longitudinal section.
Figure 2:
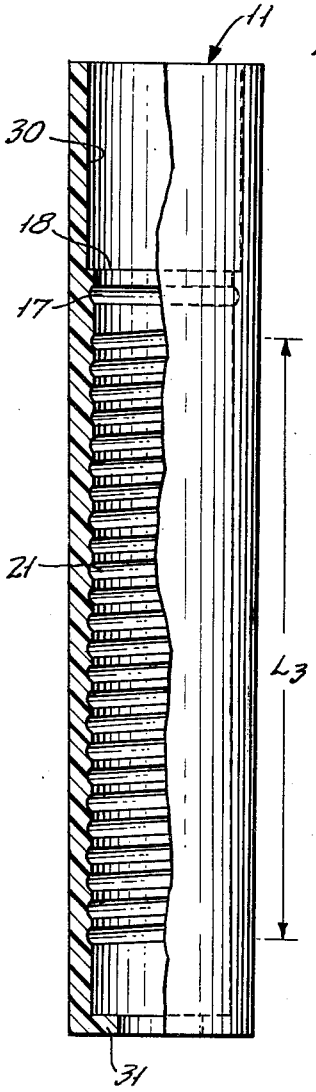
FIGS. 2, 3 and 4 are similar views of the respective outer, inner and carrier component parts of the container of FIG. 1.
Figure 3:
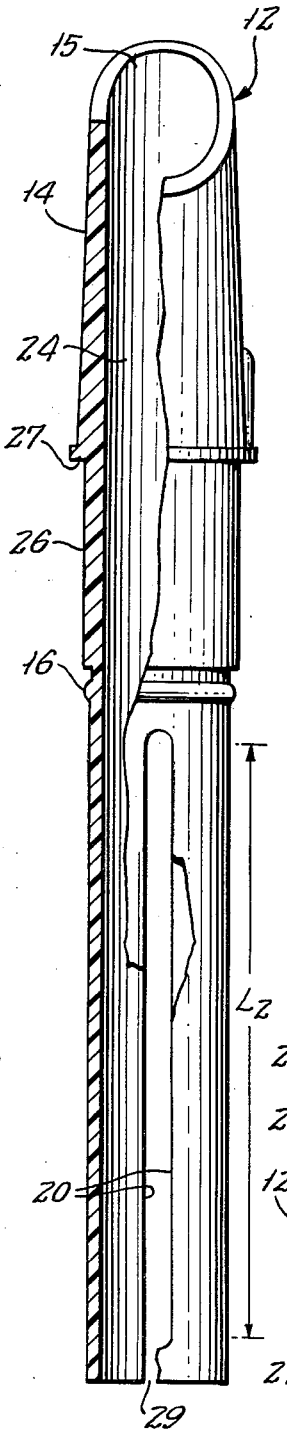
Figure 4:
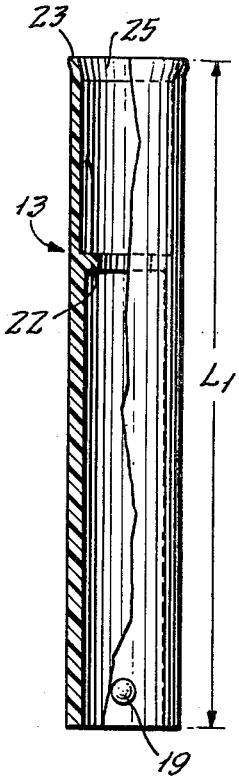

The container 10 of FIG. 1 essentially comprises three parts, an outer tubular member 11 (FIG. 2), an inner tubular member 12 (FIG. 3), and a carrier member (FIG. 4); and each of these parts may be of injection-molded single-piece plastic construction, as of polypropylene, delrin, or the like. The outer tubular member 11 surrounds most of the length of the inner tubular member 12, leaving only the projecting upper end 14 of the inner member 12 exposed for manual access, so that upon relative rotation of members 11–12, the carrier member 13 will be longitudinally displaced, for selective presentation of pomade out the dispensing or applicator end opening 15 of the inner member 12.

Coacting formations such as a circumferential bead 16 on inner member 12 and a circumferentially continuous groove 17 between axially separated shoulders in the bore of outer member 11 axially retain assembly of members 11–12 to each other, with freedom for their relative rotation. This is achieved by designing the upper shoulder 18 for slight but transiently yielding interference with bead 16 upon axial assembly of members 11–12, such assembly being completed by snap-action as bead 16 enters groove 17.

Beneath the region of axially retained coaction, propulsion mechanism is embodied in each of the three parts 11–12–13. Specifically, one or more cam followers 19 near the base end of carrier 13 extend radially outward through one or more cam slots 20 in the inner member 12, and into one or more cam grooves 21 in the bore of the outer member 11. For the form shown, these are two such cam followers 19, at diametrically opposite locations, engaging two diametrically opposed straight cam slots 20, and also engaging the respective thread grooves of a double-lead helical cam-groove formation 21.

A radially inward circumferentially continuous flange 22 near the upper end of the bore of carrier member 13 establishes a platform or reference seat for retention of pomade (not shown) which will be understood to fill the upper end of carrier 13 and to extend within the projecting end 14 of member 12, to the point of dispensing for applicator use via opening 15. The platform 22 is characterized by a central opening, for bottom-filling purposes, as will be later explained. And the upper end of carrier 13 is preferably outwardly flared at a lip 23 having close running clearance with the cylindrical bore 24 of member 12, the inner surface 25 of lip 23 being also outwardly flared, as shown. The close running clearance at lip 23 and the flared surface 25 assure efficient application of pomade-expulsion force, as will become clear.

The inner tubular member 12 is further characterized by a relatively elongate cylindrical outer surface 26, extending between the region of bead (16) retention and a shoulder 27 at the lower extreme of the dispensing end 14. End 14 is shown with a tapering contour to facilitate selective application of a removable closure cap 28, suggested by phantom outline in FIG. 1. Finally, one of the slots 20 of member 12 is open at 29, to provide a circumferential split for transient accommodation of the two cam followers 19, when carrier 13 is initially assembled into the lower end of member 12.

The outer tubular member 11 is further characterized by a cylindrical counterbore 30 coextensive with cylindrical surface 26 to provide bearing stability in the vicinity of rotary actuating access, and to provide a well-based reference for the cantilever forces to which the dispensing end 14 may be subjected. A radially inward flange 31 terminates the threads of cam 21 at the base end; flange 31 also fully overlaps the lower end of member 12 and establishes a central bottom-fill access opening, in the manner described for the platform flange 22 of carrier 13. Finally, the outer surface of member 11 is preferably slightly tapered, i.e., departs from purely cylindrical, with a slightly greater outer diameter at the upper as compared with the lower end, thereby not only facilitating removal of the molded part from its mold cavity but also enabling tightly fit reception of an applied metal or other outer decorative casing 32, should the customer (cosmetic house) so specify.

As indicated generally above, it is a feature of the invention that, for the bottom position of carrier member 13, the upper end of the carrier (i.e., the lip portion 23) shall fully lap the upper end of the cam slots 20. In other words, no matter what the actuated or unactuated condition of the carrier, the upper-end lip 23 shall effectively seal against pomade access to any part of the propulsion mechanism, specifically sealing against pomade access to either of the cam slots 20. For this condition to be met, and still to provide a maximum of pomade-carrying capacity within the container, the propulsion mechanism (19–20–21) is effectively limited to the lower half of the container, slots 20 extend as near to the base end as is mechanically feasible, and cam followers 19 are near the base end of carrier 13. At the same time, the length $L_1$ of carrier 13 is such that its upper end lip 23 is beyond the upper end of the longitudinal span $L_2$ of cam slots 20, and of course, the longitudinal span $L_3$ of the threaded cam grooves 21 need be no longer than required for axial registry with the span $L_2$ of the slotted cams. And since the propulsion mechanism is substantially one-half the length $L_4$ of the container, there is a substantial axial extent of overlap of members 11–12 within which to accommodate both the retaining means 16–17 and the bearing means 26–30.

To bottom-fill the described container, a filler tube is inserted through the base end central opening and through the opening in carrier platform 22, the carrier being in its lowermost position. Extrudable pomade is pumped into the void within the upper ends of carrier 13 and inner member 12. At the opening 15, a closure plug or cap may be applied so that the opening 15 is neatly and cleanly filled, the plug or cap being then removed and the exposed pomade covered by a disposable seal membrane, to retain freshness of pomade; alternatively, a disposable plug or cap (suggested by phantom outline 33 at opening 15, FIG. 1) may be assembled to opening 15 prior to filling, remaining for the customer to remove and dispose of it, upon first use. In the course of the filling operation, no pomade can enter any part of the propulsion mechanism.

When the customer uses the filled container, the first and all succeeding propulsion actions involve carrier-lip displacement away from the propulsion mechanism, so that under no circumstances can pomade ever enter any part of the propulsion mechanism. Propulsion force on extruded pomade is uniformly applied over the full sectional area of the cylindrical bore 24, by reason of the close lip (23) clearance and by reason of the outward flare 25 of lip 23. Since pomade intimately contacts the full and extensive area of bore 24 (above lip 23), there is ample retantion of the currently advanced relation of propulsion parts, so that pomade and/or carrier shift in the course of transport or storage is most unlikely.

While the invention has been described for the currently preferred embodiment, it will be understood that modifications may be made without departure from the claimed scope of the invention.

For example, the same principles may be applied to containers of different aspect ratios, e.g., so-called "blusher" style containers wherein the outside diameter is about 0.85 inch and the length/diameter ratio is about 3.9:1, as compared with the more pencil-like corresponding ratio of about 7.5:1 which applies for the smaller diameter device herein described.

Also, by way of example, the fact that the described structure lends itself to bottom-fill techniques does not mean that it cannot also well serve the fill house which still relies upon the pre-existing practice of top-filling its containers of the character indicated. In other words, the present construction should be understood as offering the customer his option of whether to employ a top-fill or a bottom-fill technique.

Figure 5:
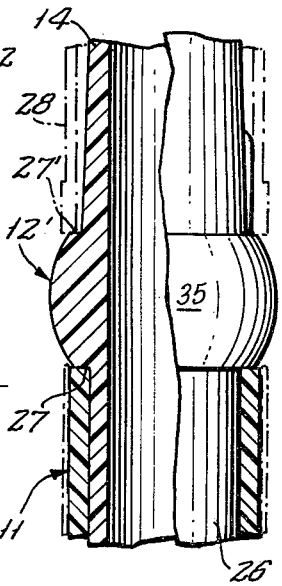
FIG. 5 is a fragmentary view in elevation to illustrate a modification.

Still further by way of example, the described construction will be seen to be well adapted to the type of container wherein a central band or bead of transparent material (in the context of an opaque outer tubular member 11 and an opaque closure cap 28) permits direct viewing of the color of pomade contents, merely by slightly modifying the inner tubular member, as shown at 12' in FIG. 5. In FIG. 5, the inner tubular member 12' is of clear injection-molded plastic and is characterized by a circumferentially continuous bead formation 35, between the flange 27' which limits application of closure cap 28 over the dispensing end 14 and the shoulder 27 to which the upper end of outer member 11 is adjacent. With inner member 12' of clear plastic, and with cap 28 and outer member 11 opaque, the bead 35 will be seen to display pomade color at all times, without need to remove cap 28. All other features of the parts 11–12'–13 remain as previously described for parts 11–12–13 in connection with FIGS. 1 to 4, it being only necessary to assure that, for the bottom position of carrier 13, the upper end of the carrier laps the upper end of the slotted cam or cams 20.

What is claimed is:

1. A bottom-fillable lipstick or the like container, comprising inner and outer elongate relatively rotatable tubular members extending between a lower base end and an upper dispensing end, said members having interengaging means retaining an axially overlapping relation of said members, said inner member having a tubular upper end which extends upwardly beyond the upper end of said outer member for manual actuating grasp and which defines the dispensing end of the container, an elongate tubular carrier member slidable within said inner tubular member and having radially outward cam-follower means at its lower end, said carrier member having internal pomade-supporting platform means near its upper end, cam formations including (a) an elongate slot in said inner tubular member and of longitudinal extent such that said carrier fully covers the upper end of said slot when said cam follower is at its lowermost position in said slot and (b) internal threads in said outer tubular member and engaged to said cam follower, said platform means and the base ends of said tubular members being open to an extent permitting removable insertion of a bottom-fill tube, whereby for the retracted position of said carrier member, the volume defined within the upper ends of said carrier member and of said inner tubular member can be bottom-filled with tube-extruded pomade without danger of pomade entry into said slot.

2. The container of claim 1, in which said slot extends for no more than substantially the lower half of the longitudinal extent of said inner tubular member.

3. The container of claim 1, in which said platform means is a radially inward circumferentially continuous flange.

4. The container of claim 1, in which the bore of said inner tubular member is continuously cylindrical at least for the length extending from the upper end of said slot to said dispensing end.

5. The container of claim 4, in which at least the upper end of said carrier member is circular and has close clearance relation with the cylindrical bore of said inner tubular member.

6. The container of claim 5, in which the upper end of said carrier member has a closer clearance relation with the cylindrical bore than does the remaining longitudinal extent of said carrier member.

7. The container of claim 1, in which said outer tubular member includes a radially inward circumferentially continuous flange.

8. The container of claim 1, in which said interengaging means comprises a radially outward circumferential bead on said inner tubular member and a radially inwardly open circumferentially continuous groove between axially separate shoulders in the bore of said outer tubular member, said bead and upper one of said shoulders having yielding interference upon assembly of said tubular members for snap-action retention of their assembly via the bead-to-groove relationship.

9. The container of claim 8, in which the bore of said outer tubular member is characterized by an elongate cylindrical counterbore extending from substantially said upper shoulder to the upper end of said outer tubular member, said inner tubular member having a correspondingly elongate cylindrical bearing portion in running clearance with said counterbore.

10. The container of claim 1, in which said cam-follower means comprises two diametrically opposite cam followers, said slot being one of two diametrically complementary slots for the respective cam followers, and the internal threads of said outer tubular member being of the double-lead variety, wherein each cam follower coacts with a different one of the threads.

11. The container of claim 1, in which the upwardly extending end of said inner member is characterized by a circumferential band adjacent the upper end of said outer member and by a projecting dispensing end axially beyond said band, and closure-cap means removably engageable to and over said dispensing end to the exclusion of said band.

12. The container of claim 11, in which said inner tubular member is of clear plastic material.

13. The container of claim 12, in which said closure-cap means and said outer tubular member are opaque.

14. The container of claim 12, in which said band is a circumferentially continuous convex bead.

* * * * *